United States Patent [19]

Grant

[11] Patent Number: 4,878,789

[45] Date of Patent: Nov. 7, 1989

[54] APPARATUS FOR CLEANING TITANIUM POTS

[75] Inventor: Louis A. Grant, Pittsburgh, Pa.

[73] Assignee: Louis A. Grant, Inc., Pittsburgh, Pa.

[21] Appl. No.: 224,794

[22] Filed: Jul. 26, 1988

[51] Int. Cl.[4] ..... B23C 3/00

[52] U.S. Cl. ..... 409/143; 409/164; 409/185; 409/190; 409/211; 409/216

[58] Field of Search ..... 409/137, 138, 139, 143, 409/162, 163, 164, 170, 174, 183, 185, 189, 190, 191, 197, 198, 199, 201, 205, 204, 211, 216, 224

[56] References Cited

U.S. PATENT DOCUMENTS

| | | | |
|---|---|---|---|
| 2,750,178 | 3/1952 | McCallum . | |
| 2,911,662 | 11/1959 | Sedgwick | 409/185 |
| 2,963,725 | 12/1960 | Bredtschneider | 409/185 |

FOREIGN PATENT DOCUMENTS

| | | | |
|---|---|---|---|
| 36391 | 3/1977 | Japan | 409/138 |
| 182011 | 10/1984 | Japan | 409/162 |
| 7513217 | 5/1977 | Netherlands | 409/139 |
| 1000175 | 2/1983 | U.S.S.R. | 409/143 |

OTHER PUBLICATIONS

Brochure entitled "Dosco Roadheader MK2A Tunnelling Machine" Jan., 1975.

*Primary Examiner*—Daniel Howell

*Attorney, Agent, or Firm*—Webb, Burden, Ziesenheim & Webb

[57] ABSTRACT

Apparatus for cleaning the inside of a metallurgical vessel including an inclined foundation and ways on the inclined foundation to support the carriage of a mobile cleaning device. The mobile cleaning device has a carriage which moves along the ways on said inclined foundation. The mobile cleaning device has a pivotally mounted boom with a rotary shaft having a cutting head mounted on its end and bits on the cutting head. A support stand is located adjacent the upper end of the inclined foundation for holding a metallurgical vessel in a stationary position during cleaning.

8 Claims, 3 Drawing Sheets

APPARATUS FOR CLEANING TITANIUM POTS

BACKGROUND OF THE INVENTION

The invention relates generally to mobile apparatus for cleaning a titanium pot or crucible or other metallurgical vessel mounted at a stationary location and more particularly to a mobile boom-mounted rotary head cleaning apparatus for removing titanium sponge from the interior of the pot or crucible.

FIELD OF THE INVENTION

Crucibles are utilized for processing titanium chloride to form sponge for subsequent processing into titanium metal. During processing, the sponge accumulates in the crucible in a homogenous mixture of titanium sponge and sodium, and it is necessary to remove the accumulated mixture from the crucible so that the crucible can be reused. The inner surface of the crucible wall is frustoconical in shape and the bottom has a curved configuration. The crucible is maintained stationary during the cleaning operation because it is a large and cumbersome piece of equipment, and it is not practical to move the crucible relative to the cleaning apparatus. The portion of the crucible support stand which holds the crucible is, however, tiltable about a horizontal axis to permit loose material in the crucible to be easily and quickly removed. It is important that the crucible and the hydraulic equipment for the cleaning apparatus are located at a distance from each other because of the possibility of an oil leak from the hydraulic equipment which could contaminate the titanium sponge being removed from the crucible so that the sponge could not be used.

DESCRIPTION OF THE PRIOR ART

In the past, crucibles have generally been cleaned manually using pneumatic chipping equipment, but this is not a practical operation since it is time consuming, expensive and noisy For this reason, it is desirable to clean crucibles by using automatic equipment to increase the speed of the cleaning operation.

SUMMARY OF THE INVENTION

The invention is a substantially fully automated cleaning apparatus which is computer controlled and which is movable relative to a stationary crucible to be cleaned. The apparatus includes a movable carriage supporting an elongated boom carrying a motor driven rotary cutting head at its distal end. The boom can be moved in both the horizontal and vertical directions so that bits on the rotary cutting head can remove material from the inner areas of the crucible. The movable carriage is mounted on skids which travel along spaced parallel ways or tracks which are supported on a frame on a concrete foundation which is fixed to a platform which supports the crucible support stand. The carriage is moved longitudinally relative to a crucible supported in the support stand to assure access of the cutting head to the complete interior of the crucible. The cutting head has a plurality of replaceable cutting bits on its periphery which have tool steel tips. The rotary cutting head has a rounded tapered shape so that the cutting bits on the head can contact the material in the entire crucible. The rotary cutting head is mounted on the distal end of a rotatable shaft on a boom which is driven by an electric motor so that no hydraulic equipment is located in the general proximity of the crucible.

The crucible and the cleaning apparatus are mounted on a unitary platform so that the coordinates between the axis of the cutting head and the axis of the interior of the crucible are known and the movement of the cutting head is computer controlled which provides for efficient and rapid cleaning without the danger of damage to the crucible wall or bottom caused by misalignment of the cutting head relative to the crucible.

DESCRIPTION OF THE PREFERRED EMBODIMENT

Figure 1:
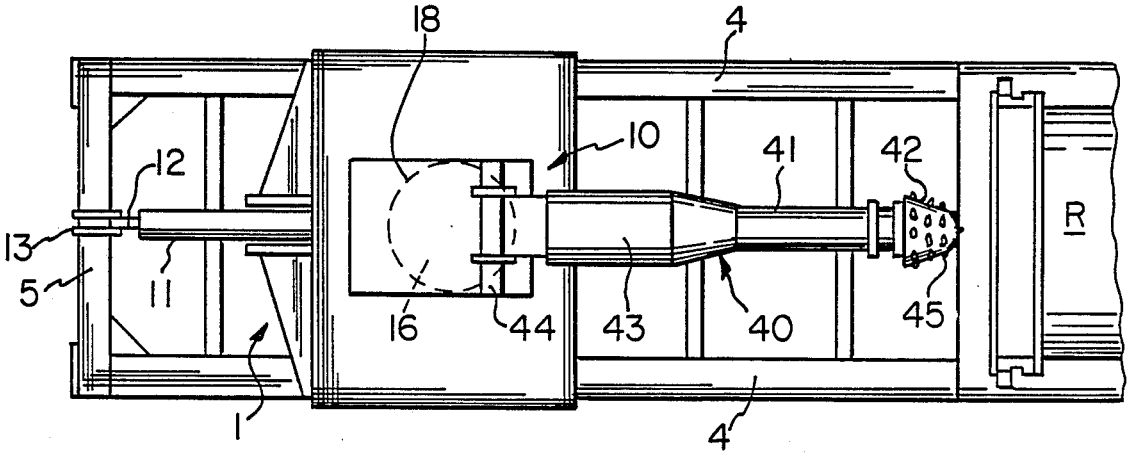
FIG. 1 is a plan view of the cleaning apparatus.
Figure 2:
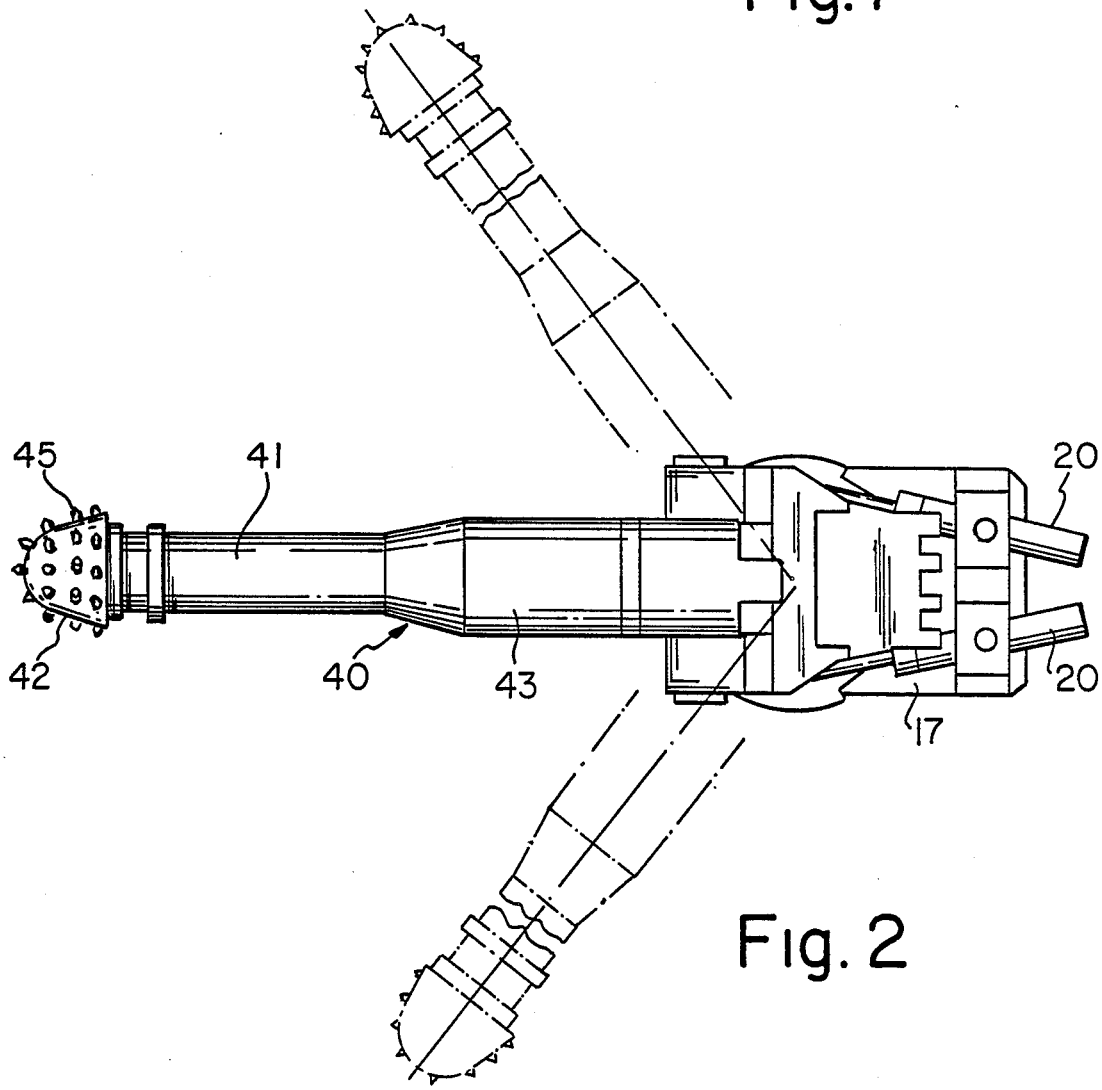
FIG. 2 is a schematic plan view of the boom portion of the cleaning apparatus shown in FIG. 1 showing different positions of the boom in dotted lines.
Figure 3:
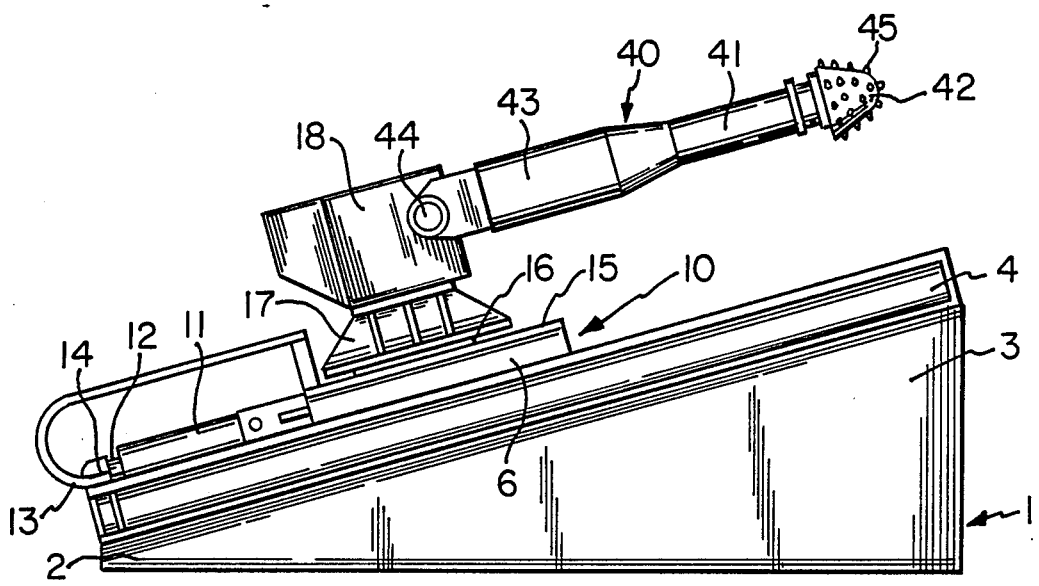
FIG. 3 is a side elevation of the cleaning apparatus shown in FIG. 1.
Figure 4:
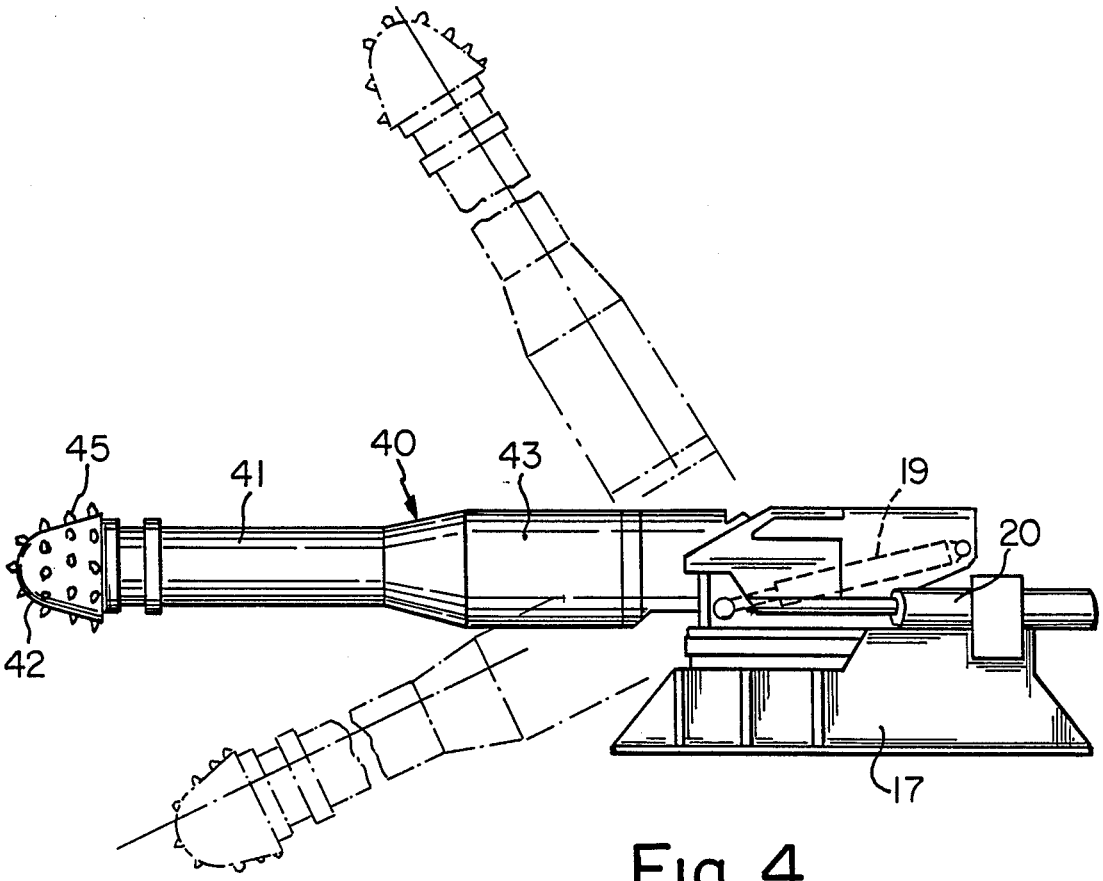
FIG. 4 is a side elevation of the boom portion of the cleaning apparatus shown in FIG. 1 showing different positions of the boom in dotted lines.

With reference to FIGS. 1–4 of the drawings, the cleaning apparatus of the invention is mounted on a frame on an elongated concrete foundation 1. The upper surface of the foundation is inclined upwardly from the lower rear end 2 which is adjacent to the shop floor to the upper forward end 3 which is adjacent to a crucible support stand. A pair of spaced, substantially parallel, elongated ways or tracks 4 extend along the inclined upper surface of the foundation from the lower rear end 2 to the upper forward end 3. A mobile carriage 10 is mounted on skids 11, wheels (not shown) or crawlers (not shown) and is supported on skids 6 on the ways 4. The cleaning apparatus includes a base 15 mounted on the skids 6 which supports a turntable 16 on its upper surface. An intermediate member 17 is supported on the upper surface of the turntable 16. A boom support frame 18 is mounted on the upper end of the intermediate member 17 and an elongated boom 40 is pivotally mounted on the frame 18 by a pivot shaft 44. The boom includes an elongated rotary shaft 41 which supports a cutting head 42 on its distal end. The rotary shaft 41 is mounted within a rear boom member 43 which is pivotally mounted on frame 18 by the shaft 44. A hydraulic cylinder 19 for raising and lowering the boom 40 in a vertical plane as shown in FIG. 4 of the drawings is pivotally attached to frame 18 and the rod for cylinder 18 is pivotally attached to member 17. The turntable 16 is rotated by hydraulic cylinders 20 to move the boom and the cutting head 42 in the horizontal direction as shown in FIG. 2 of the drawings. The hydraulic cylinders and the electric motor for rotating the cutting head may be manually controlled but preferably are automatically controlled by a computer which is programmable according to the size and internal configuration of the crucible which is held in the support stand to be cleaned. The manual controls and the computer are located in a control pulpit C adjacent to the foundation 1.

The cutting head 42 is provided with replaceable cutting bits 45 having tool steel tips in order to rapidly remove the sponge from the interior of the crucible. The cutting bits are standard items which are well known to those skilled in the art and form no part of the invention.

Figure 5:
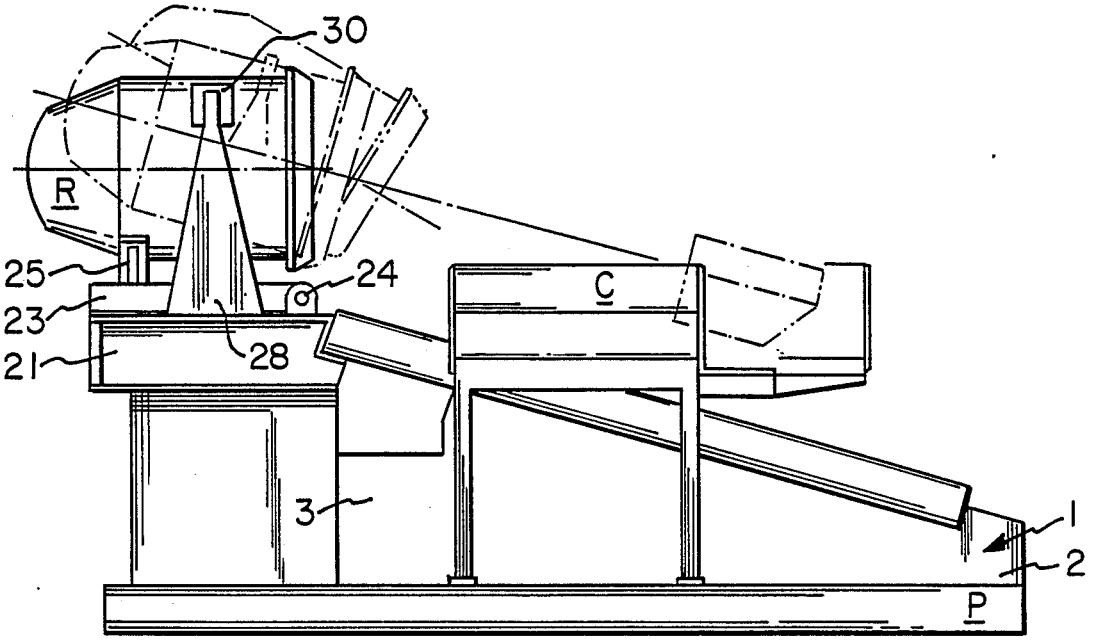
FIG. 5 is a side elevation of the crucible support stand with a crucible in place.
Figure 6:
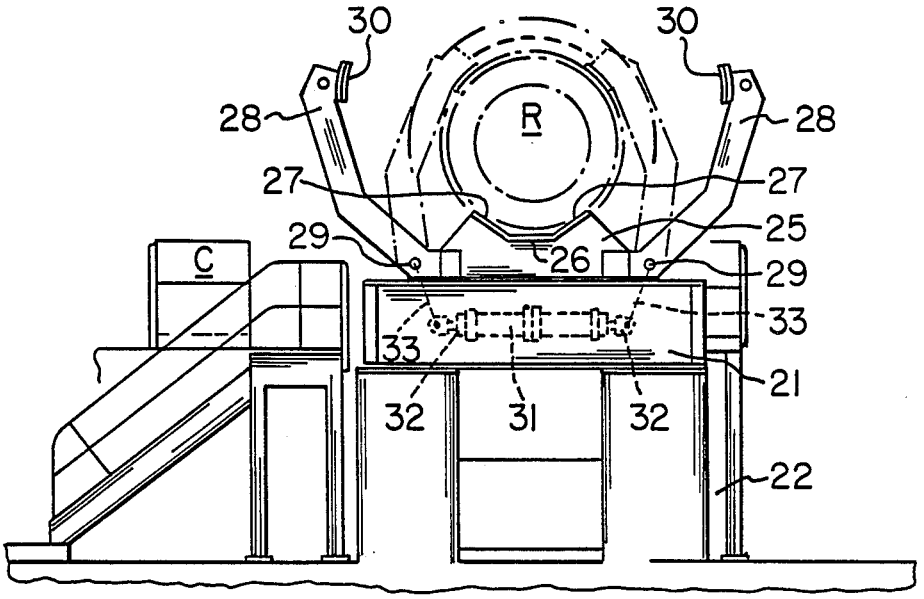
FIG. 6 is a front elevation of the crucible support stand with a crucible in place.

With specific reference to FIGS. 5 and 6 of the drawings, a fixed crucible support stand is located adjacent the upper forward end 3 of foundation 1. The stand has a base portion 21 supported on legs 22 which are fixed to a platform P. A member 23 is pivotally attached at one end by a shaft 24 to the top of base portion 21 and a plurality of longitudinally spaced cradles 25 are attached to the upper surface of member 23. Each cradle 25 is formed with a flat bottom 26 and opposed angled sides 27 in order to accommodate the cylindrical exterior surface of a crucible R as shown in FIG. 6 of the drawings. The cradle support stand base portion 21 is mounted on the legs 22 so that a crucible supported in the cradles 25 will have its opening or mouth adjacent to the raised forward end 3 of the inclined foundation 1.

A pair of laterally spaced clamping arms 28 are pivotally attached at 29 to the forward end of the upper surface of the member 23 of the support stand. This end of the support stand faces the raised forward end 3 of foundation 1. The upper end of each clamping member 28 has a clamping pad 30 fixed thereto which contacts the exterior surface of a crucible resting in the cradles 25 when the arms 28 are pivoted toward each other into the clamping position to hold a crucible in the support stand during the cleaning and subsequent emptying of the loose material from the crucible. Clamping arms 28 are pivoted about pivots 29 by a hydraulic cylinder 31 which is shown in dotted lines in FIG. 6 of the drawings. The cylinder has rods 32 attached to pivot links 33 which rotate members 28 upon extension and retraction of the cylinder rods.

After a crueible R is placed in the support stand and clamped in place by the clamping pads 30 on the clamping arms 28, the carriage 10 is advanced upwardly toward the crucible along the ways 4 by a hydraulic cylinder 11 which is attached to the rear end of the carriage. The hydraulic cylinder 11 has a rod 12 which has its distal end attached to a fixed clevis 13 on a cross piece 5 of the frame supporting the ways 4 by a pin 14. Extension of the rod 12 from hydraulic cylinder 11 moves the carriage 10 along the ways 4 toward the raised forward end 3 of foundation 1 and the mouth of the crucible R, and retraction of the rod 12 moves carriage 10 along the ways 4 toward the rear end 2 of the foundation 1 away from the crucible R.

While the invention is specifically described for cleaning titanium sponge crucibles, it will be understood by those skilled in the art that it may also be used to clean the interior of other metallurgical vessels such as ladles, molds and aluminum crucibles. Additionally, it will be understood by those skilled in the art that the cleaning carriage 10 may be mounted on crawlers or rubber tires if desired without departing from the scope of the invention. The important thing is that the carriage is movable relative to a stationary crucible to be cleaned so that the cutting head can attack the interior of the crucible and remove sponge therefrom.

While a preferred embodiment of the invention has been shown and described herein, it is to be understood that the invention may be embodied within the scope of the appended claims.

I claim:

1. Apparatus for cleaning the inside of a metallurgical vessel comprising an inclined foundation having a lower end and a raised end, a mobile carriage having cleaning means carried thereon, support means on said inclined foundation for supporting said mobile carriage, said mobile carriage mounted on said support means and including means for permitting movement of said mobile carriage along said support means relative to said ends of said inclined foundation, means connected between said lower end of said foundation and said mobile carriage for moving said mobile carriage along said support means, said cleaning means including a pivotally mounted elongated boom having a rotary shaft with a distal end, a rotatable cutting head mounted on said distal end of said rotary shaft and drive means on said cleaning means for rotating said rotary shaft and said cutting head, means adjacent said raised end of said inclined foundation adapted to hold a metallurgical vessel in a stationary position during cleaning, whereby said rotatable cutting head is positioned within a stationary metallurgical vessel mounted in said means adjacent said raised end of said inclined foundation to contact the inner surface of a metallurgical vessel to remove material from the interior of the metallurgical vessel.

2. Apparatus as set forth in claim 1 wherein said means adjacent said raised end of said inclined foundation adapted to hold a metallurgical vessel is a support stand, said support stand comprising a base portion, a member above said base portion, a plurality of spaced cradles mounted on said member adapted to support a metallurgical vessel and spaced pivotally mounted clamping arms mounted on said base, each of said clamping members having a clamping pad at the upper end and means for pivoting said clamping arms between an open position and a closed clamp position wherein said pads contact the exterior of a metallurgical vessel supported in said cradles, whereby a metallurgical vessel can be held in a fixed position in said cradles by said clamping pads when said clamping arms are in the closed clamp position.

3. Apparatus as set forth in claim 2 wherein said member of said support stand is pivotally attached to said base portion of said support stand and means for pivoting said member relative to said base portion, whereby said member can be tilted to empty loose material from a metallurgical vessel in said support stand.

4. Apparatus as set forth in claim 2 wherein each of said cradles has a flat bottom and a pair of spaced angled sides, whereby said angled sides and said flat bottom of said cradles accommodate the exterior surface of a cylindrical metallurgical vessel located in said support stand.

5. Apparatus as set forth in claim 1 wherein said cleaning means includes a first means for pivoting said boom to move said cutting head in a vertical plane and a second means for moving said boom and said cutting head in a horizontal direction, whereby said cutting head can be located in desired positions relative to the interior of a metallurgical vessel supported in said support stand.

6. Apparatus as set forth in claim 1 including a plurality of spaced replaceable cutting bits on the external surface of said rotatable cutting head, whereby said cutting bits are adapted to contact material within a metallurgical vessel supported in said support stand.

7. Apparatus as set forth in claim 1 wherein said support means on said foundation is a pair of spaced substantially parallel ways.

8. Apparatus as set forth in claim 1 wherein said means connected between said lower end of said foundation and said mobile carriage for moving said mobile carriage on said support means is a hydraulic cylinder attached to said carriage and having a rod extending therefrom with the distal end of said rod being attached adjacent to said lower end of said foundation, whereby extension and retraction of said rod relative to said cylinder moves said mobile carriage along said support means relative to said ends of said inclined foundation.

* * * * *